US007056066B2

(12) United States Patent
Irvine

(10) Patent No.: US 7,056,066 B2
(45) Date of Patent: Jun. 6, 2006

(54) APPARATUS AND METHOD FOR INSERTING SHEET PILES INTO A SOIL FORMATION

(75) Inventor: John E. Irvine, Atlanta, GA (US)

(73) Assignee: CMI Limited Corporation, Atlanta, GA (US)

( * ) Notice: Subject to any disclaimer, the term of this patent is extended or adjusted under 35 U.S.C. 154(b) by 105 days.

(21) Appl. No.: 10/926,234

(22) Filed: Aug. 25, 2004

(65) Prior Publication Data

US 2006/0045631 A1 Mar. 2, 2006

(51) Int. Cl.
*E02B 5/16* (2006.01)

(52) U.S. Cl. ..... 405/274; 405/272

(58) Field of Classification Search ..... 405/274–287, 405/267

See application file for complete search history.

(56) References Cited

U.S. PATENT DOCUMENTS

| | | | | |
|---|---|---|---|---|
| 748,705 | A * | 1/1904 | Davis | 405/274 |
| 878,141 | A * | 2/1908 | Jackson | 405/274 |
| 3,825,465 | A | 7/1974 | Stock | 161/112 |
| 4,094,156 | A | 6/1978 | Dumont | 61/53.5 |
| 4,355,448 | A | 10/1982 | Ezaki | 29/413 |
| 4,664,560 | A * | 5/1987 | Cortlever | 405/267 |
| 5,259,705 | A * | 11/1993 | Breaux et al. | 405/267 |
| 5,364,682 | A | 11/1994 | Tanaka et al. | 428/138 |
| 5,503,503 | A | 4/1996 | Glass et al. | 405/274 |
| 5,511,355 | A | 4/1996 | Dingler | 52/729.5 |
| 5,618,135 | A * | 4/1997 | Glass et al. | 405/279 |
| 5,803,672 | A | 9/1998 | Glass et al. | 405/274 |
| 6,135,675 | A | 10/2000 | Moreau | 405/284 |

(Continued)

FOREIGN PATENT DOCUMENTS

DE 580118 6/1933

OTHER PUBLICATIONS

NCEL Technical Note, N-1773, Timber Piling Barrier and Chemical Preservation Annual Costs Comparison, Jun. 1987, D. Pendleton and T. O'Neill, Naval Civil Engineering Laboratory Port Hueneme CA 93043.

(Continued)

*Primary Examiner*—Frederick L. Lagman
(74) *Attorney, Agent, or Firm*—Thomas, Kayden, Horstemeyer & Risley, LLP

(57) ABSTRACT

Yet another embodiment of the present disclosure relates to a sheet pile installation apparatus for inserting a sheet pile vertically into a soil formation, the installation apparatus including an elongated body configured to releasably receive the sheet pile, the body having an upper end, a lower end, a lower edge, a top surface, a bottom surface, and at least one aperture formed at said lower end. The installation apparatus further includes a catch having a first portion and a second portion, the catch being pivotally mounted in the aperture about said pivot axis such that the first portion and the second portion are disposed on opposed sides of the lower end of the body when the catch is in an at-rest position. The first portion of the catch is configured such that insertion of the body into the soil formation rotates the first portion upwardly such that the first portion engages a lower end of the sheet pile disposed adjacent the top surface of the body.

34 Claims, 12 Drawing Sheets

U.S. PATENT DOCUMENTS

| | | | | |
|---|---|---|---|---|
| 6,231,271 | B1 | 5/2001 | Glass et al. | 405/274 |
| 2002/0112428 | A1 | 8/2002 | Dingler | 52/309.16 |
| 2004/0013474 | A1 | 1/2004 | Weyant et al. | 405/276 |
| 2004/0013475 | A1 | 1/2004 | Weyant et al. | 405/284 |
| 2004/0013476 | A1 | 1/2004 | Weyant et al. | 405/284 |

OTHER PUBLICATIONS

NCEL Technical Note, N-1811, "Plastic Coatings and Wraps for New Marine Timber Piling," May 1990, David E. Pendleton, Naval Civil Engineering Laboratory Port Hueneme CA 93043-5003.

* cited by examiner

APPARATUS AND METHOD FOR INSERTING SHEET PILES INTO A SOIL FORMATION

This application is related to co-pending U.S. utility patent applications entitled "Elongated Structural Members for Use in Forming Barrier Walls," filed on Jun. 4, 2004 and accorded Ser. No. 10/861,301, and "Anchor System for Use in Forming Barrier Walls," filed on Jun. 4, 2004 and accorded Ser. No. 10/861,637, which are entirely incorporated herein by reference.

TECHNICAL FIELD

The present disclosure relates generally to methods and apparatus for use in forming driven wall structures such as sea walls, piers, dikes, barrier walls and the like, constructed of extruded structural panels. More specifically, the present disclosure relates to sheet pile installation apparatus for inserting sheet piles vertically into soil formations, and methods of use thereof.

BACKGROUND

Barrier walls that are formed from a plurality of elongated, vertically oriented piles typically are driven into the earth to a depth sufficient to support the piles in an upright attitude. In some cases, the piles are in the form of extruded structural sheet piles and are formed with male and female opposed edges so that similar sheet piles can be locked together at their adjacent side edges to form a continuous barrier wall. Because of the strength required of the sheet piles when being driven into the earth and the strength required under load conditions, typically, the sheet piles have been made of steel or aluminum. Frequently, steel and aluminum sheet piles have over-sized cross sections to allow for the effects of corrosion. The additional material used in over-sizing increases the costs of the sheet piles due to the material itself, as well as the costs associated with handling the heavier piles.

In recent years, sheet piles have been constructed of polyvinyl chloride and other plastics having relatively low tensile strength and high compression strength. The sheet piles are extruded in a continuous manufacturing process. In order to provide the strengths in the sheet piles necessary to withstand the loads that are expected to be applied to the sheet piles, such as while being driven vertically into the earth, the thicknesses of the sheet piles have been increased over the typical thickness of similar sheet piles formed of steel or aluminum. Further increases in the thickness of the plastic provides a diminishing return. The increased bending strength does not offset the cost of the additional plastic.

In order to produce sheet piles formed of a synthetic material that are to be used as driven piles in the formation of a barrier wall, the sheet piles have often been formed in various strengthening cross-sectional shapes, such as V-shapes, Z-shapes, U-shapes, etc., that provide resistance to bending in response to the application of axial and/or lateral loads to the sheet piles. Further, the panels have been constructed so as to have at their opposite edges male and female locking elements, so that the edge of one pile locks with and supports the edge of an adjacent pile.

After the first sheet piles have been driven into place, subsequent sheet piles can be driven into place adjacent the previously driven sheet piles with their male and female edges locked together as they are driven, thereby forming a continuous barrier wall. The barrier wall typically is held in place with a series of horizontally placed structural members, or wales, that extend along the exposed outer surface of the barrier wall. The wales frequently are held in place with a plurality of tie rods. The tie rods extend through the wale, the barrier wall, and the soil disposed behind the barrier wall, and have one end secured to the wale and another end which is secured to a force abutter. Typically, the force abutter is a reinforced cement wall disposed a desired distance behind the barrier wall such that adequate force is exerted from the force abutter through the tie rods on the barrier wall, thereby maintaining the barrier wall in the desired position.

As previously noted, although measures can be taken to increase the ability of extruded plastic sheet piles to withstand the large axial loads applied during driving operations, it is not uncommon to damage sheet piles during driving operations. Miscalculations and/or misjudgments related to the required thickness of the sheet piles, or simple over application of driving force, can cause the sheet piles to be damaged. Removal and replacement of the damaged sheet piles is costly in both time and materials.

As well, warpage, twisting, deflection, etc., of a structural panel during driving operations can cause the male and female locked edges to separate between adjacent sheet piles. If the separation is detected, once again, the sheet pile must be removed and re-driven or replaced. If the separation goes undetected, the structural integrity of the barrier wall can be severely compromised. This is especially harmful where the barrier wall is being used to prevent the spread of potentially harmful liquids, such as when used on industrial facilities, around garbage dumps, during the clean up of polluted areas, etc.

Therefore, there is a need for improved sheet pile installation apparatus which address these and other shortcomings of the prior art.

SUMMARY

Briefly described, the present disclosure relates to a sheet pile installation apparatus for inserting a sheet pile vertically into a soil formation, the installation apparatus including an elongated body of uniform cross-section along its length, the body having an upper end, a lower end, a lower edge, a top surface, a bottom surface, and at least one aperture formed at the lower end. The installation apparatus further includes a clamp assembly disposed on the upper end including a clamp bracket disposed on the top surface, a clamp pivotally mounted to the bracket, the clamp including a proximal end and a distal end, the proximal end being configured to engage a top end of the sheet pile, and a spring mounted to the clamp bracket and the distal end such that the proximal end is urged inwardly toward the top surface when the spring is in an at-rest position. The installation apparatus also includes a catch including a first portion and a second portion separated by a pivot axis, the catch being pivotally mounted in the aperture about the pivot axis such that the first portion and the second portion are disposed on opposed sides of the body when the catch is in an at-rest position. The first portion of the catch is configured such that insertion of the body into the soil formation rotates the first portion upwardly such that the first portion engages a lower end of the sheet pile disposed adjacent the top surface of the body.

A further embodiment of the present disclosure relates to a sheet pile installation apparatus for inserting a sheet pile vertically into a soil formation, the installation apparatus including an elongated body arranged and configured to releasably receive the sheet pile, the body having an upper end, a lower end, a lower edge, a top surface, a bottom surface, and at least one aperture formed at said lower end. The installation apparatus further includes a catch having a first portion and a second portion separated by a pivot axis, the catch being pivotally mounted in the aperture about the pivot axis such that the first portion and the second portion are disposed on opposed of the body when the catch is in an at-rest position. The first portion is configured such that insertion of the body into the soil formation rotates the first portion upwardly such that the first portion engages a lower end of the sheet pile disposed adjacent the top surface of the body.

Yet another embodiment of the present disclosure relates to a sheet pile installation apparatus for inserting a sheet pile vertically into a soil formation, the installation apparatus including an elongated body configured to releasably receive the sheet pile, the body having an upper end, a lower end, a lower edge, a top surface, a bottom surface, and at least one aperture formed at said lower end. The installation apparatus further includes a catch having a first portion and a second portion, the catch being pivotally mounted in the aperture about said pivot axis such that the first portion and the second portion are disposed on opposed sides of the lower end of the body when the catch is in an at-rest position. The first portion of the catch is configured such that insertion of the body into the soil formation rotates the first portion upwardly such that the first portion engages a lower end of the sheet pile disposed adjacent the top surface of the body.

The present disclosure also relates to a method of inserting a sheet pile vertically into a soil formation utilizing an installation apparatus. The method includes: placing the sheet pile adjacent the installation apparatus; engaging a lower end of the sheet pile; urging the installation apparatus into the soil formation such that the installation apparatus pulls the sheet pile downwardly into the soil formation.

Other objects, features and advantages of the present disclosure will become apparent upon reading the following specification, taken in conjunction with the accompanying drawings.

BRIEF DESCRIPTION OF THE SEVERAL VIEWS OF THE DRAWINGS

Many aspects of the sheet pile installation apparatus can be better understood with reference to the following drawings. The components in the drawings are not necessarily to scale, emphasis instead being placed upon clearly illustrating the principles of the present sheet pile installation apparatus. Moreover, in the drawings, like reference numerals designate corresponding parts throughout the several views.

DETAILED DESCRIPTION

Figure 1:
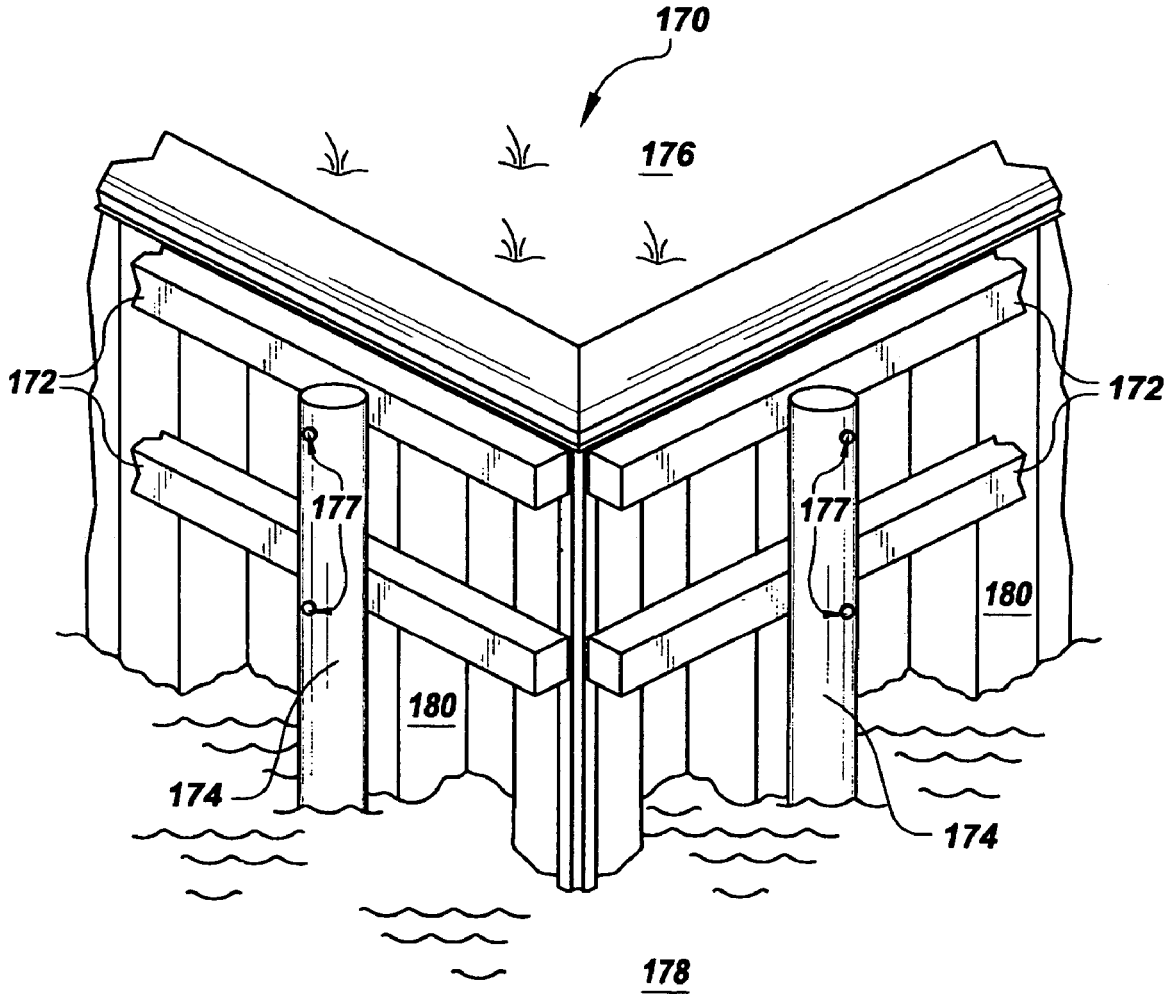
FIG. 1 is a perspective, fragmentary view of a barrier wall constructed in accordance with an embodiment of the present disclosure, used as a seawall.

Reference will now be made in detail to the description of the sheet pile installation apparatus as illustrated in the drawings. While the sheet pile installation apparatus will be described in connection with these drawings, there is no intent to limit it to the embodiment or embodiments disclosed therein. On the contrary, the intent is to cover all alternatives, modifications and equivalents included within the spirit and scope of the sheet pile installation apparatus as defined by the appended claims.

In particular, FIG. 1 illustrates a wall structure, in the form of a sea wall 170, constructed of elongated structural panels 180, wales 172, and piles 174 according to the present disclosure. The sea wall 170 forms a retainer for the soil 176 on the backside of the sea wall 170, with water 178 at the front surface. The panels 180 extend vertically with lower ends received in the subsoil below the lower level of the body of water 178. Wales 172 are mounted along outer surfaces of the structural panels 180 and accept anchor members 177 which extend to force abutters (not shown) or similar anchors on the opposite side of the sea wall 170. A typical force abutter would comprise an anchor wall of poured reinforced concrete placed behind the barrier wall 170 and extending generally parallel to the barrier wall 170. Several anchor members can be connected to a single force abutter 170.

Figure 2A:
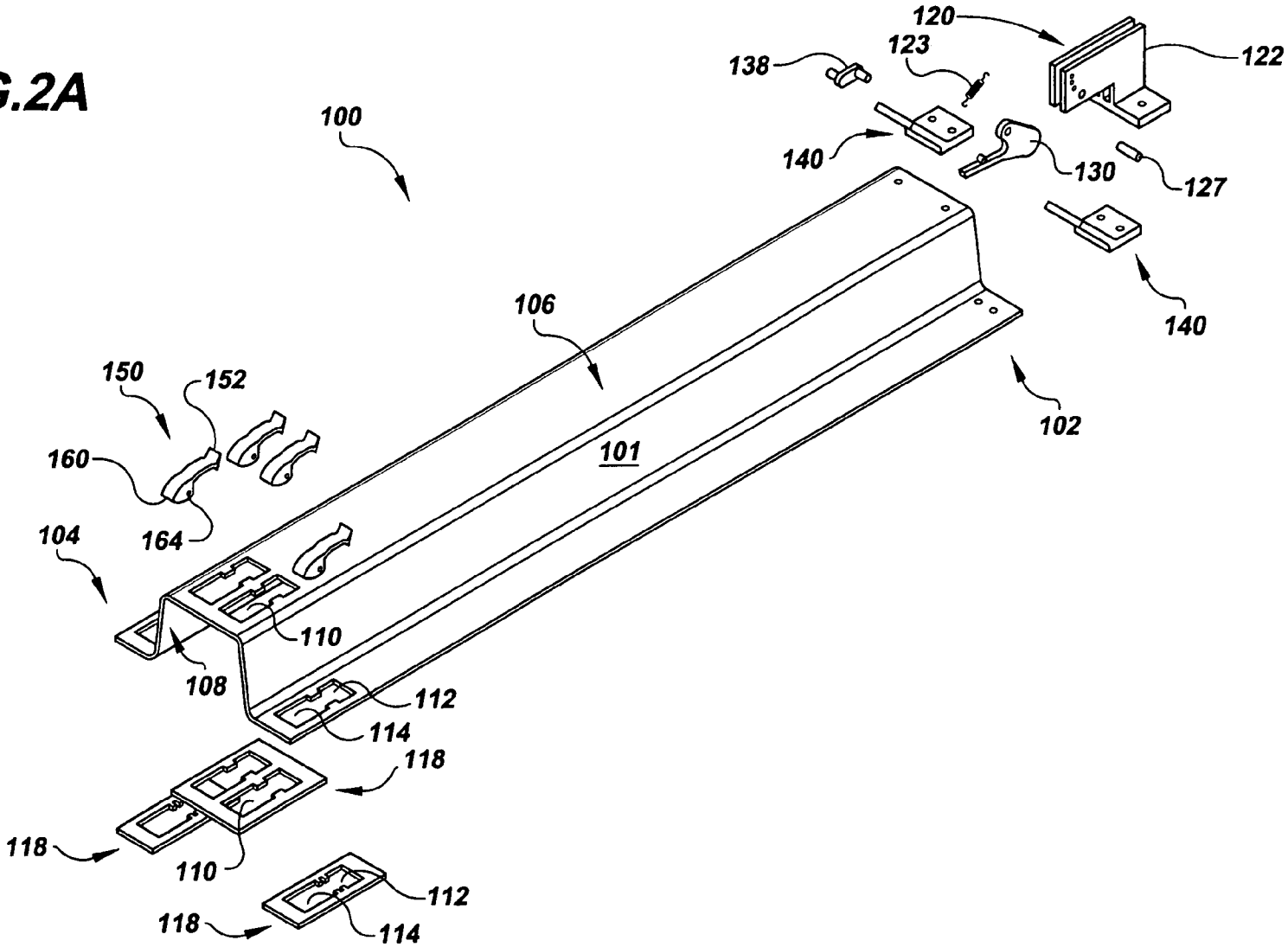
FIG. 2A is a perspective, exploded view of an embodiment of a sheet pile installation apparatus in accordance with the present disclosure.
Figure 2B:
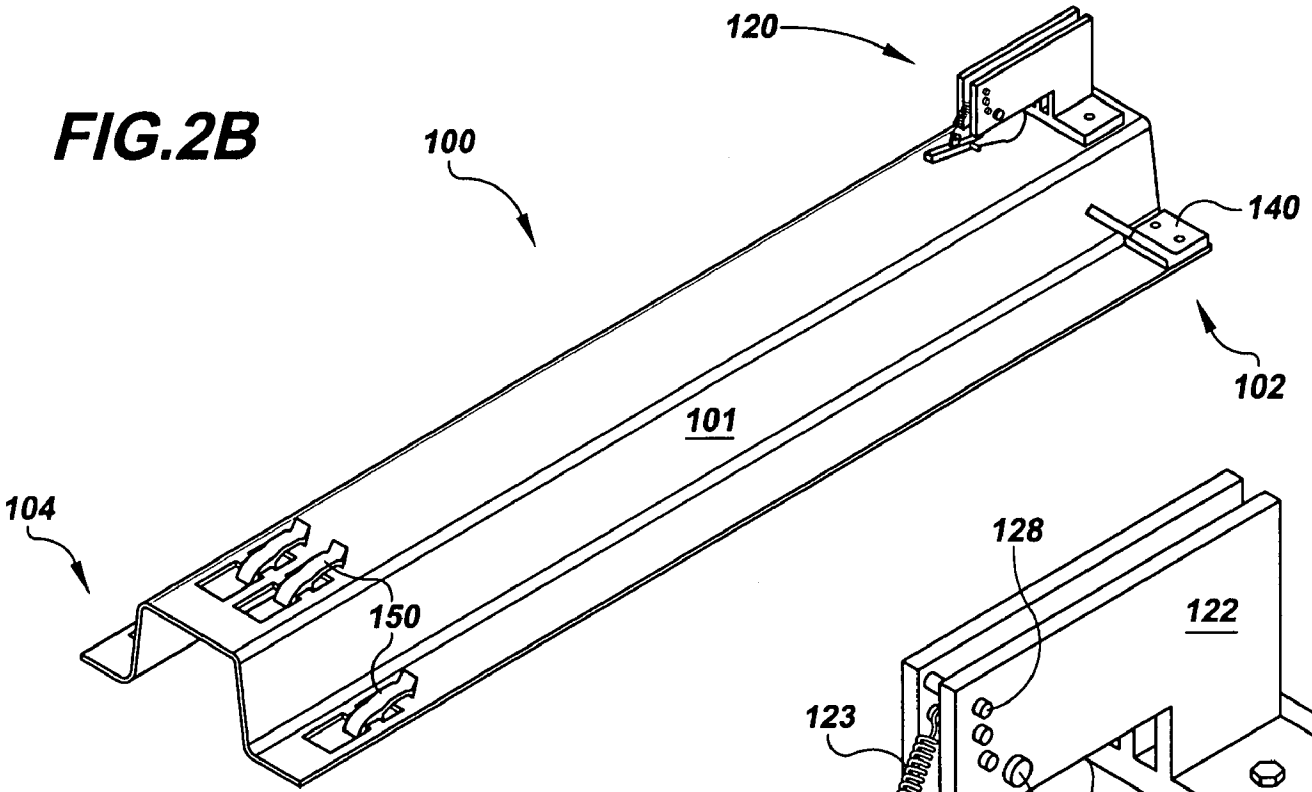
FIG. 2B is a perspective view of the embodiment of the sheet pile installation apparatus, as shown in FIG. 2A.

Referring now to FIGS. 2A and 2B, a sheet pile installation apparatus 100 is shown, as would be used to insert a sheet pile 180 into a soil formation in accordance with the present disclosure. Preferably, the installation apparatus 100 includes an elongated body 101 having an upper end 102 and a lower end 104, with a clamp assembly 120 disposed on the upper end 102 and one or more catches 150 being mounted in a respective catch aperture 110 formed in the lower end 104 of the elongated body 101. Preferably, each catch 150 includes a first portion 152, or engagement end, and a second portion 160, or camming end, separated by a pivot pin aperture 164. The pivot pin aperture 164 is configured to receive a pivot pin (not shown) such that the opposing ends of the pivot pin extend beyond the sides of the catch 150. Bottom plates 118 including catch apertures 110 similarly dimensioned to those formed elongated body 101 are then used to pivotally secure each catch 150 to the installation apparatus 100. The opposing ends of each pivot pin are received within a pair of pivot grooves 165 formed adjacent each catch aperture 110 of the bottom plate 118. Next, the bottom plate 118 and its associated catch 150 are secured to the lower end 104 of the installation apparatus 100. Preferably, a matching pair of pivot grooves 165 are formed in the bottom surface 108 of elongated body 101 50 that each catch 150 freely pivots about the pivot pin. Note, it is possible to form the pivot grooves 165 in both the elongated body 101 and bottom plate 118, as described, solely in the bottom surface 108 of the elongated body 101, or solely in the bottom plate 118, so long as the pivot grooves 165 allow rotational motion of each catch 150.

Figure 2C:
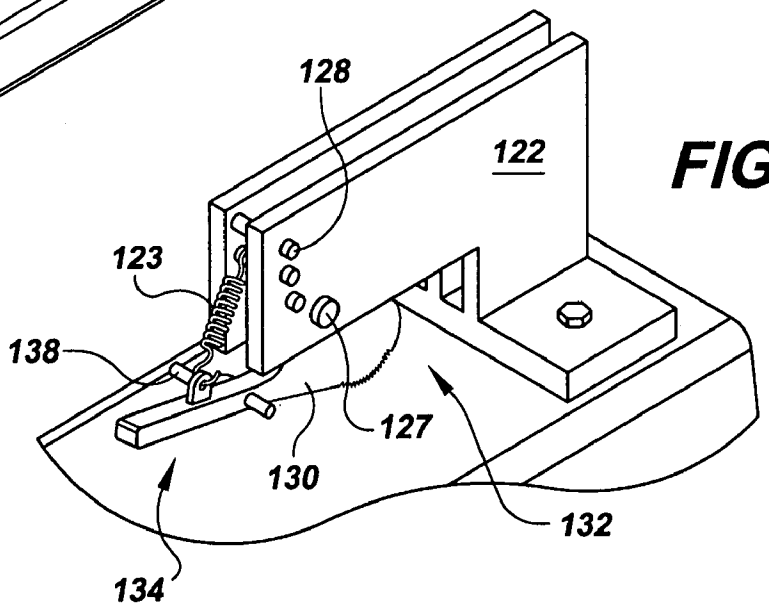
FIG. 2C is a perspective fragmentary view of the clamp assembly of the sheet pile installation apparatus, as shown in FIG. 2.

As shown, the clamp assembly 120 includes a clamp bracket 122 secured to the upper end 102 of the installation apparatus 100, a clamp 130 pivotally mounted to the clamp bracket 122, and a spring 123 secured at one end to the clamp bracket 122 and at the opposing end to the clamp 130. As best seen in FIG. 2C, the spring 123 is mounted such that the biasing force of the spring 123 causes an engagement end 132 of the clamp 130 to be urged inwardly toward the top surface 106 of the elongated body 101. The amount of biasing force exerted by the spring 123 on the clamp 130 is adjusted by connecting the spring 123 to the clamp bracket 122 by means of variably spaced spring pins 128. When desired, the engagement surface 132 is urged away from the top surface 106 by a user urging the actuation arm 134 toward the top surface 106, in opposition to the force that is exerted on the clamp 130 by the spring 123. A clamp lock 138 is pivotally mounted to the clamp 130 so that the clamp 130 can be secured in the disengaged position without the user having to apply constant force (FIG. 6B). Preferably, retention brackets 140 are also provided on the upper end 102 of elongated body 101.

Figure 3:
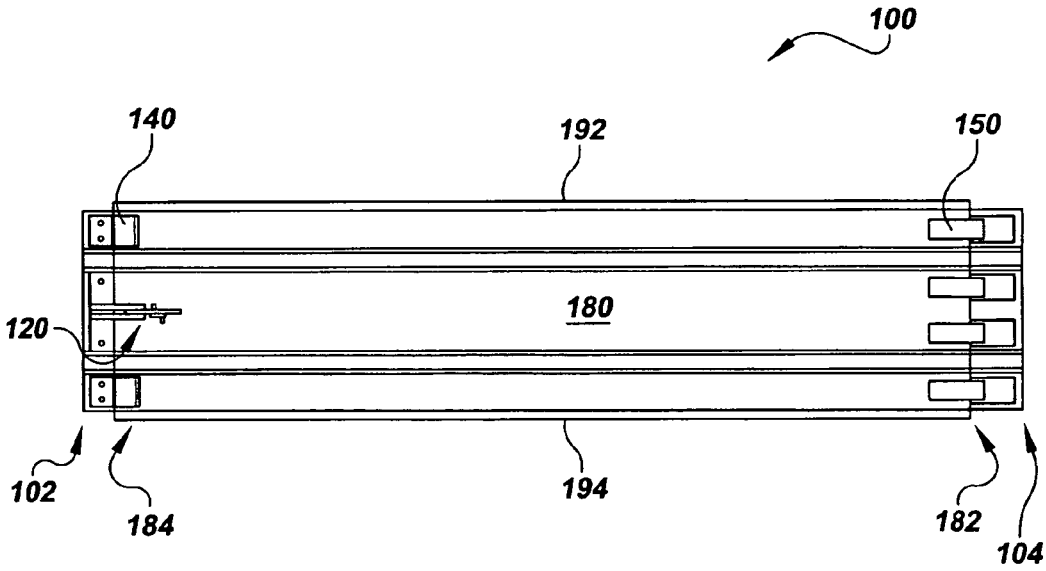
FIG. 3 is a front view of the embodiment of the sheet pile installation apparatus as shown in FIGS. 2A and 2B.
Figure 4:
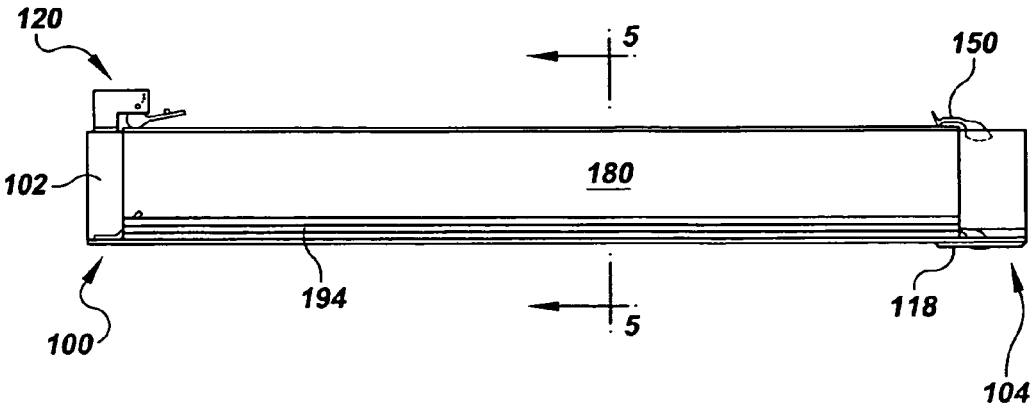
FIG. 4 is a side elevation of the embodiment of the sheet pile installation apparatus as shown in FIGS. 2A and 2B.
Figure 5:
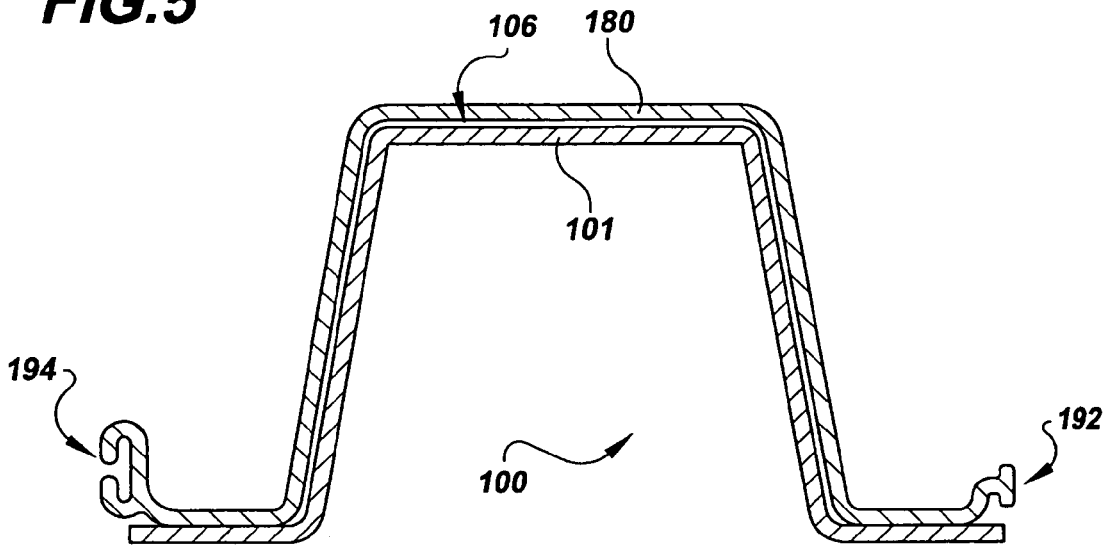
FIG. 5 is a partial, cross-sectional view of the sheet pile installation apparatus and associated sheet pile, taken along line 5—5 of FIG. 4.
Figure 7A:
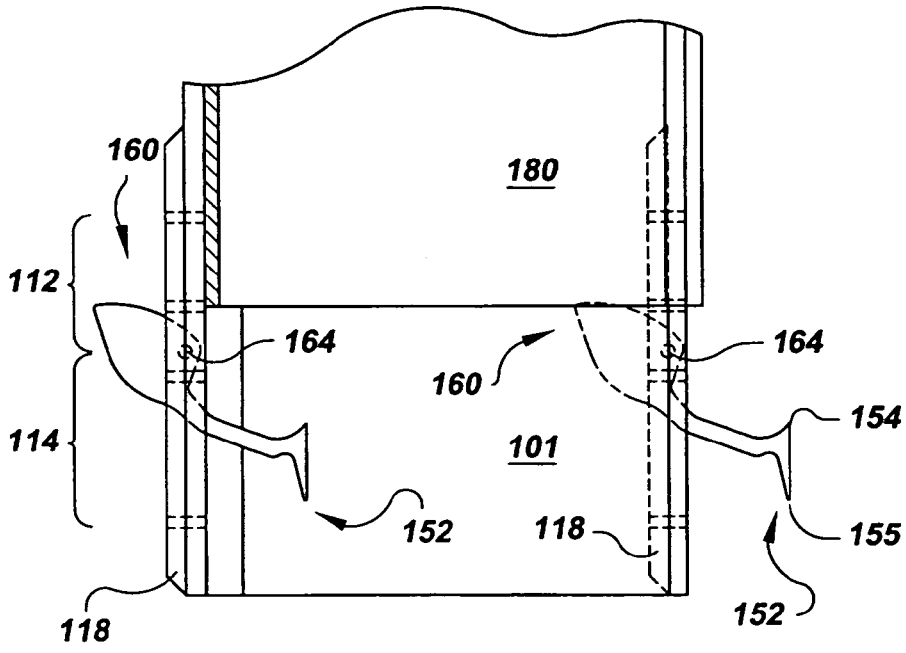
FIG. 7A–7C illustrate partially cut-away, side elevations of the sheet pile installation apparatus and associated sheet pile as shown in FIG. 4.
Figure 7B:
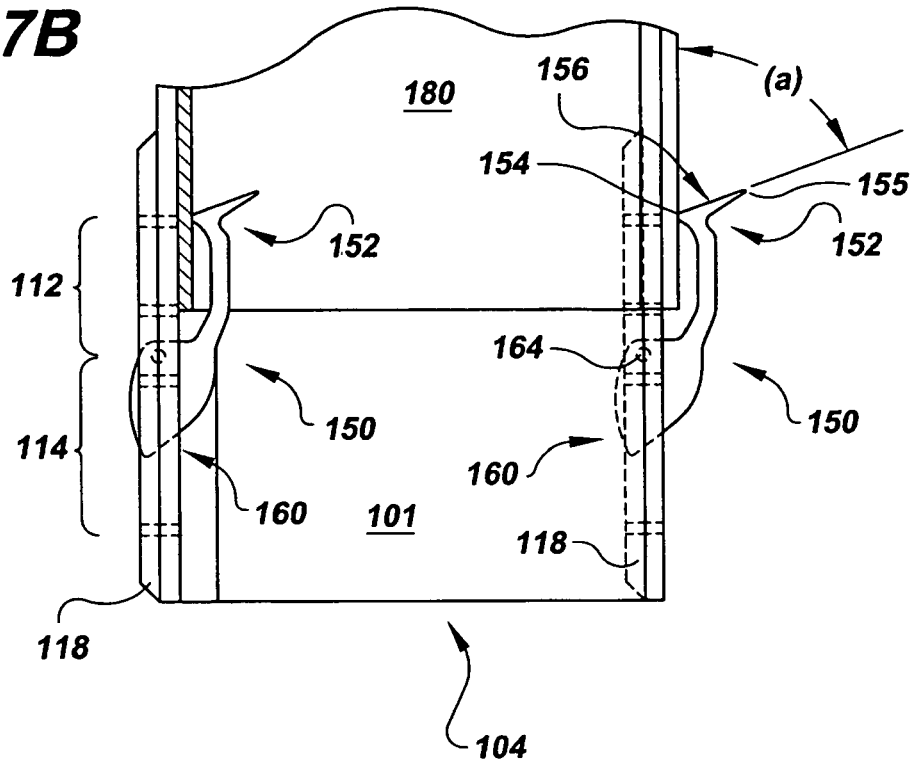

As shown in FIGS. 3 and 4, a sheet pile 180 has been positioned on the installation apparatus 100 in preparation for insertion of the sheet pile 180 into a soil formation. Preferably, the male locking element 192 and female locking element 194 of the sheet pile 180 both extend beyond the lateral edges of the elongated body 101, as best shown in FIG. 5, to facilitate installation of the sheet pile 180 with a previously installed sheet pile. Prior to installation, the upper end 184 of the sheet pile 180 is secured to the elongated body 101 by the clamp assembly 120 and the pair of retention brackets 140. Note, the catches 150 are shown in a position which they would assume as the lower end 104 of the installation apparatus 100 is driven downwardly through the soil formation. Prior to the installation apparatus 100 being driven into soil, the catches 150 are positioned as shown in FIG. 7A. The catches are configured such that they maintain a substantially horizontal position when the installation apparatus 100 is vertical and no force is being exerted on them. As shown in FIG. 5, the cross-sectional shape of the elongated body 101 is substantially similar to that of the sheet pile 180 so that the elongated body 101 provides structural support to the sheet pile 180 as the installation apparatus 100 is driven into the soil.

Figure 6A:
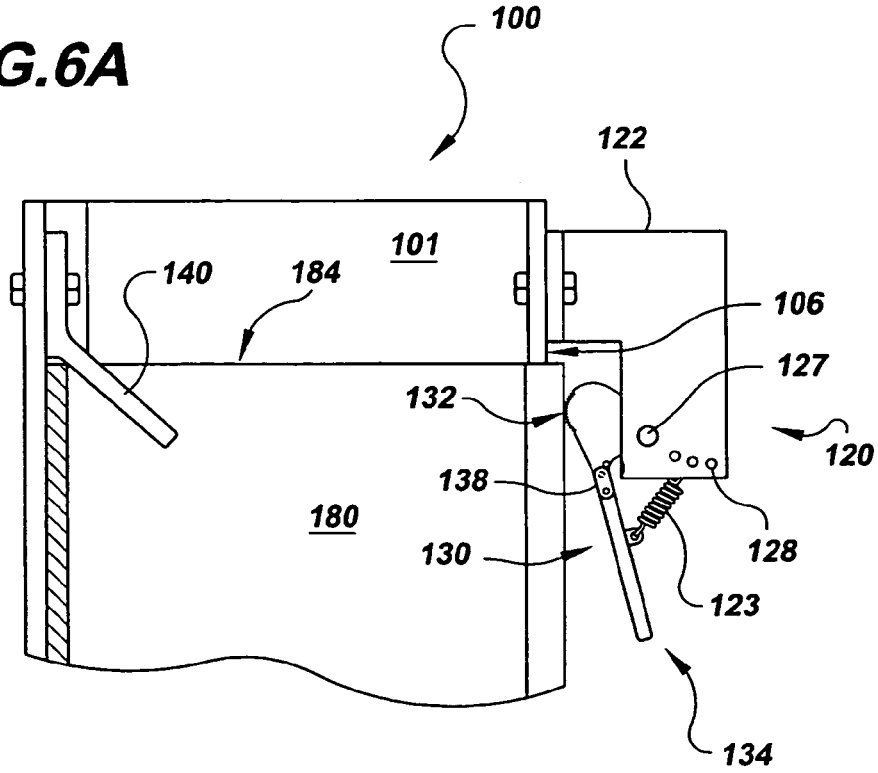
FIGS. 6A and 6B illustrate partially cut-away, side elevations of the sheet pile installation apparatus and associated sheet pile as shown in FIG. 4.
Figure 6B:
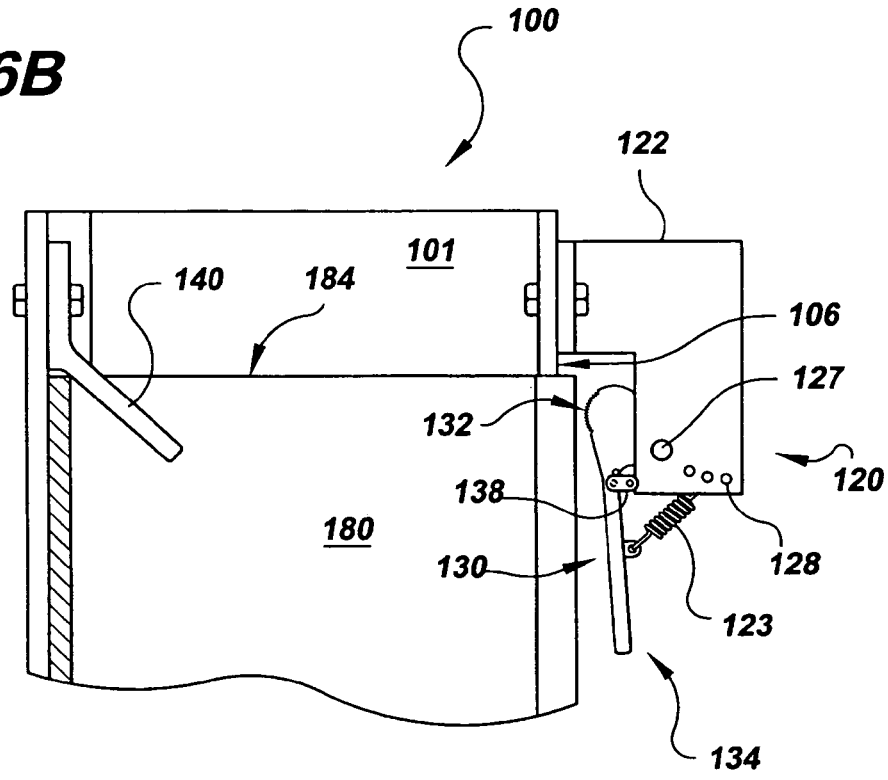

Referring to FIG. 6A, the installation process for a sheet pile 180 begins by securing the sheet pile 180 to the installation apparatus 100. As shown, the upper end 184 of the sheet pile 180 is secured to the installation apparatus 100 by the clamp assembly 120. Note, while securing the sheet pile 180 to the installation apparatus 100, the installation apparatus 100 can be positioned vertically, horizontally, or in any desired position that facilitates placing the sheet pile 180 on the apparatus 100. Preferably, the upper end 184 of the sheet pile 180 is moved upwardly along the elongated body 101 until the upper end 184 contacts the engagement surface 132 of the clamp 130. Because the clamp 130 is in the at-rest position prior to placement of the sheet pile 180, the engagement surface 132 is positioned adjacent the top surface 106 of the elongated body 101. As the sheet pile 180 is urged toward the clamp assembly 120, the force exerted on the clamp 130 by the spring 123 is overcome, thereby causing the engagement surface 132 to be urged away from the upper surface 106 of the elongated body 101. Motion of the sheet pile 180 along the elongated body 101 continues until the upper end 184 comes into contact with the retention arms 142. Force exerted by the spring 123 on the clamp 130 causes the engagement surface 160 to "pin" the sheet pile 180 to the elongated body 101. With the installation apparatus 100 positioned vertically, the engagement surface 132, preferably a toothed surface, prevents downward motion of the sheet pile 180 relative to the installation apparatus 100 because any downward motion of the sheet pile 180 relative to the installation apparatus 100 causes counterclockwise motion of the clamp 130 about the clamp pin 127. This motion results in the engagement surface 132 "digging into" the sheet pile 180 with greater force.

As well, as shown in FIG. 6B, the clamp 130 can be secured so that the engagement surface 132 does not contact the sheet pile 180 as the upper end 184 is positioned underneath the clamp assembly 120. Prior to installing the sheet pile 180, a user can urge the actuation arm 134 clockwise, thereby causing the engagement surface 132 to rotate away from the upper surface 106 of the elongated body 101. The clamp 130 can be secured in the disengaged position by positioning the clamp lock 138 in the recessed lobe 139 formed on the clamp bracket 122. Once the upper end 184 is properly positioned, the clamp lock 138 is disengaged, thereby allowing the force exerted on the clamp 130 by the spring 123 to cause the engagement surface 132 to rotate toward the upper surface 106 of the elongated body 101, thereby securing the sheet pile 180 to the installation apparatus 100.

As shown in FIG. 7A, when the installation apparatus 100 is positioned vertically prior to insertion into the soil, the catches 150 are in an at-rest position wherein the first portion 152 and the second portion 160 are disposed on opposite sides of the elongated body 101. As such, the first portion 152, or engagement end, remains out of the way of the sheet pile 180 as the sheet pile 180 is positioned adjacent the elongated body 101, as previously discussed. Prior to insertion of the installation apparatus 100 and associated sheet pile 180 into the soil, a side edge locking element 192 or 194 of the sheet pile 180 (FIG. 5) is aligned with a mating locking element of a previously driven sheet pile. Once the locking elements 192–194 have been properly aligned, force is exerted on the installation apparatus 100, thereby driving the installation apparatus 100, and subsequently the sheet pile 180, into the soil.

As the lower end 104 of the installation apparatus 100 is driven into the soil, the engagement end 152 of the catch 150 rotates upwardly until its leading edge 154 comes into contact with the sheet pile 180. Preferably, upward motion of the engagement end 152 during insertion of the installation apparatus 100 into the soil results from the engagement end 152 being longer than the second portion 160, or camming end. The same result can be obtained by exposing a larger surface area of the engagement end 152 to the soil as compared to the surface area of the camming end 160. As shown, the engagement end 152 includes a deflector 156. The deflector 156 is configured such that the engagement end 152 rotates upwardly relative to the installation apparatus 100 during insertion into soil, and downwardly relative to the installation apparatus 100 during extraction from the soil. Moreover, during insertion of the installation apparatus 100 into the soil, the force of the soil acting on the deflector 156 causes the leading edge 154 to grip the sheet pile 180. As such, the catches 150 pin the sheet pile 180 to the installation apparatus 100 during driving operations. Therefore, as driving force is applied to the installation apparatus 100 the catches 150 simultaneously pull the sheet pile 180 into the soil formation, without the requirement that driving force be applied to the upper end 184 of the sheet pile 180, as having with previously existing methods. Pulling the sheet pile 180 into the soil formation with the catches 150 alleviates the previously noted problems that occur when sheet piles 180 are subjected to compressive loads in the axial direction.

After the installation apparatus 100 has been driven to the desired depth, the upper end 184 of the sheet pile 180 is released by disengaging the clamp 130. As shown in FIG. 6B, the user rotates the actuator arm 134 toward the sheet pile 180, thereby causing the engagement surface 132 to be disengaged from the sheet pile 180. The clamp 130 is secured in the disengaged position by positioning the clamp lock 138 in the lobe recess 139 formed on the clamp bracket 122. Next, the installation apparatus 100 is withdrawn from the soil formation.

Figure 7C:
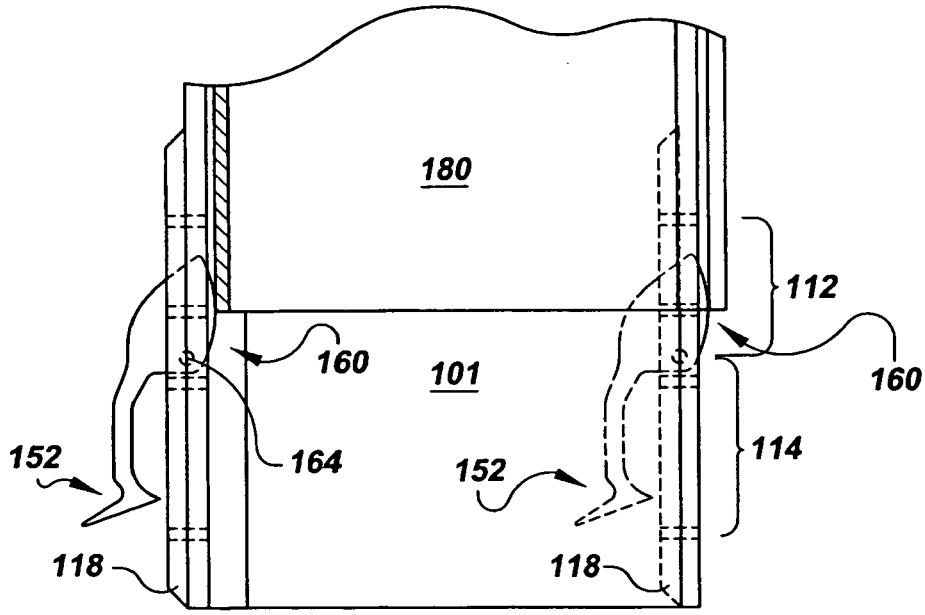

As previously noted, the deflector 156 causes the engagement end 152 of the catch 150 to both rotate upwardly during insertion of the installation apparatus 100 into the soil and cause the leading edge 154 to grip the sheet pile 180. Conversely, upon extraction of the installation apparatus 100 from the soil, the deflector 156 serves to disengage the leading edge 154 from the sheet pile 180 and cause the engagement end 152 to rotate downwardly with respect to the installation apparatus 100, as shown in FIG. 7C. Preferably, the deflector 156 includes a planar surface extending from the leading edge 154 to the trailing edge 155 of the engagement end 152. Ideally, when the leading edge 154 is adjacent the sheet pile 180, the planar surface of the deflector 156 forms an angle (a) that is less than 90° with the surface of the sheet pile 180, preferably that angle ($\alpha$) being between 60° and 80°.

As shown in FIG. 7C, as the installation apparatus 100 is withdrawn, the engagement end 152 of the catch 150 rotates downwardly and through the bottom section 114 of the catch aperture 110. This prevents the engagement end 152 from further contacting the sheet pile 180 as the installation apparatus 100 is withdrawn from the soil formation and the sheet pile 180 remains therein. Preferably, the camming end 160 of the catch 150 rotates through the top section 112 of the catch aperture 110. In so doing, the camming end 160 of the catch 150 contacts the sheet pile 180, thereby urging it away from the top surface 106 of the elongated body 101. As such, friction between the installation apparatus 100 and sheet pile 180 is reduced, thereby facilitating leaving the sheet pile 180 in the soil formation as the installation apparatus 100 is withdrawn. Note, embodiments are envisioned wherein the camming end 160 does not engage the sheet pile 180 during extraction of the installation apparatus 100 from the soil formation.

Figure 8:
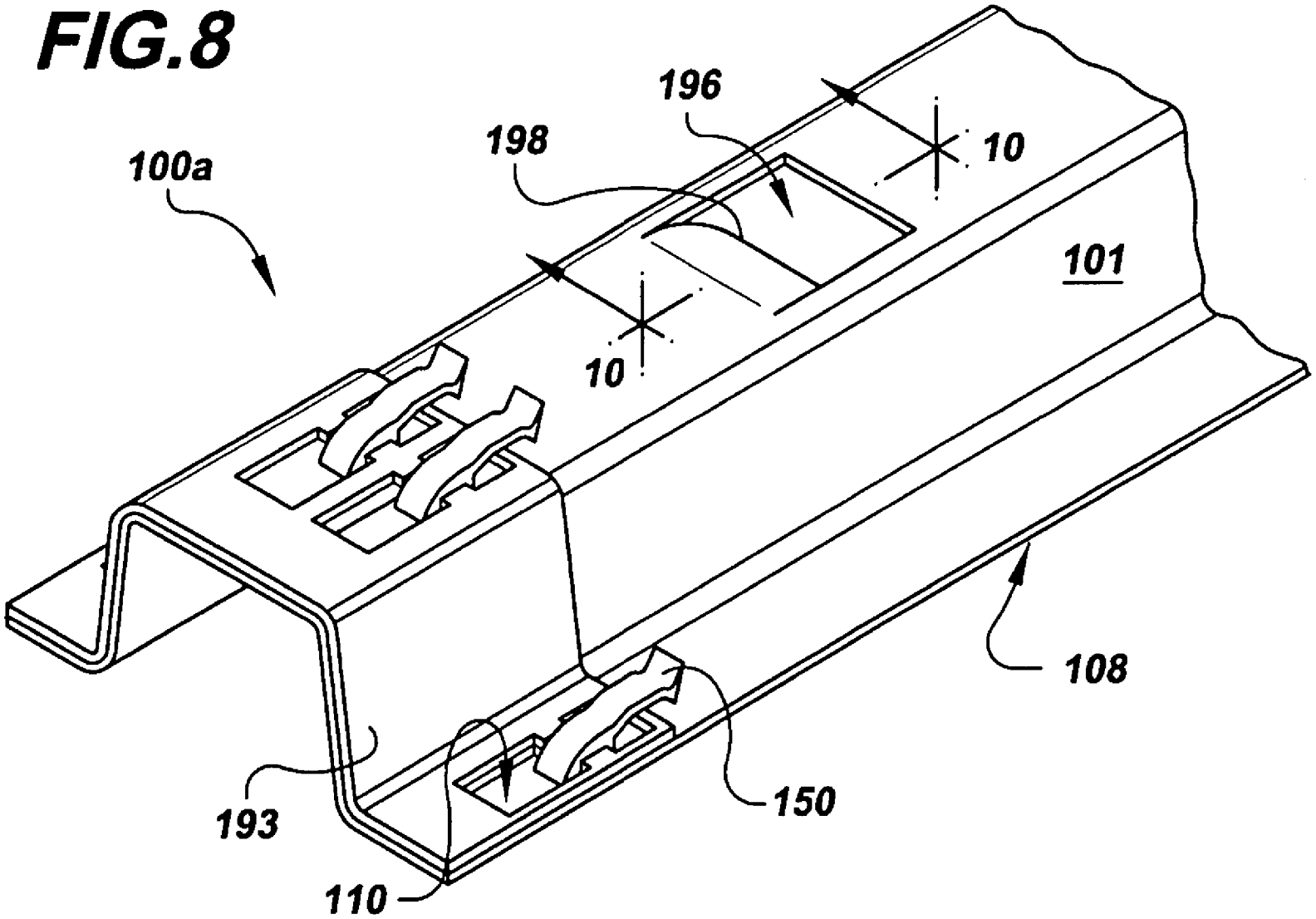
FIG. 8 is a partially cut-away, perspective view of an alternate embodiment of a sheet pile installation apparatus in accordance with the present disclosure.

An alternate embodiment of a sheet pile installation apparatus 100*a* is shown in FIG. 8. The installation apparatus 100*a* includes a ledge 193 disposed on the upper surface 106 at the lower end 104 of the elongated body 101. As shown, the ledge 193 includes catch apertures 110 dimensioned similarly to those formed in elongated body 101 and has a thickness that is substantially similar to the thickness of the sheet pile 180 (FIGS. 9A–9C) that is to be inserted into the soil formation. As well, the installation apparatus 100*a* includes a removal aperture 196 formed in the elongated body 101 with a scoop 198 formed along the bottom edge of the removal aperture 197.

Figure 9A:
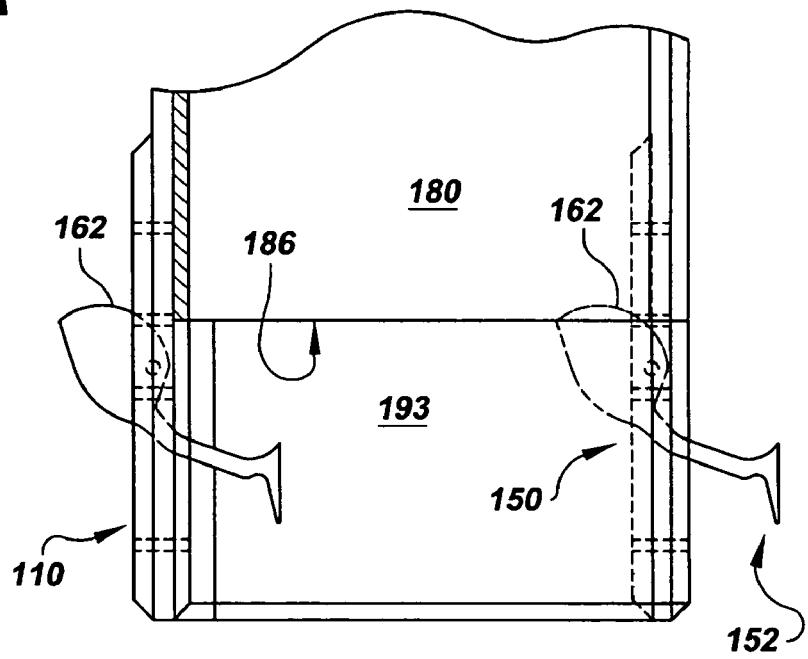
FIGS. 9A–9C illustrate partially cut-away, side elevations of the alternate embodiment of the sheet pile installation apparatus, as shown in FIG. 8.

As shown in FIG. 9A, when the installation apparatus 100*a* is positioned vertically prior to insertion into the soil, the catches 150 are in an at-rest position wherein the engagement end 152 in the camming end 160 are disposed on opposite sides of the installation apparatus 100*a*. As previously noted, the ledge 193 preferably has a thickness that is substantially similar to that of the sheet pile 180 that is to be inserted into the soil formation. As such, the ledge 193 protects the lower edge 186 of the sheet pile 180 from exposure to soil, rocks, debris, etc., as the installation apparatus 100*a* is driven into the soil, thereby preventing possible damage to the lower edge 186.

Figure 9B:
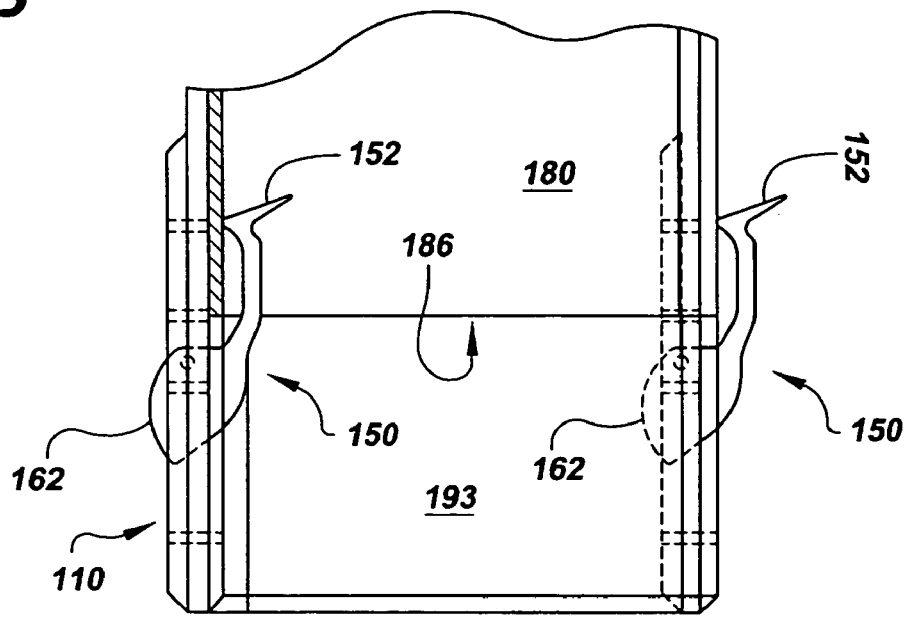

As shown in FIG. 9B, as the installation apparatus 100*a* is driven into the soil, the engagement end 152 of the catch 150 rotates upwardly until the engagement end 152 comes into contact with the sheet pile 180. During insertion of the installation apparatus 100*a* into the soil, the force of the soil acting on the engagement end 152 causes the engagement end to grip the sheet pile 180. In so doing, the catches 150 pin the sheet pile 180 to the installation apparatus 100*a* and ensure that the lower edge 186 of the sheet pile 180 remains protected behind the ledge 193 during driving operations. As with the previously discussed embodiment, as driving force is applied to the installation apparatus 100*a* the catches 150 pull the sheet pile 180 into the soil formation. As such, driving force need not be applied directly to the upper end of the sheet pile 180.

Figure 9C:
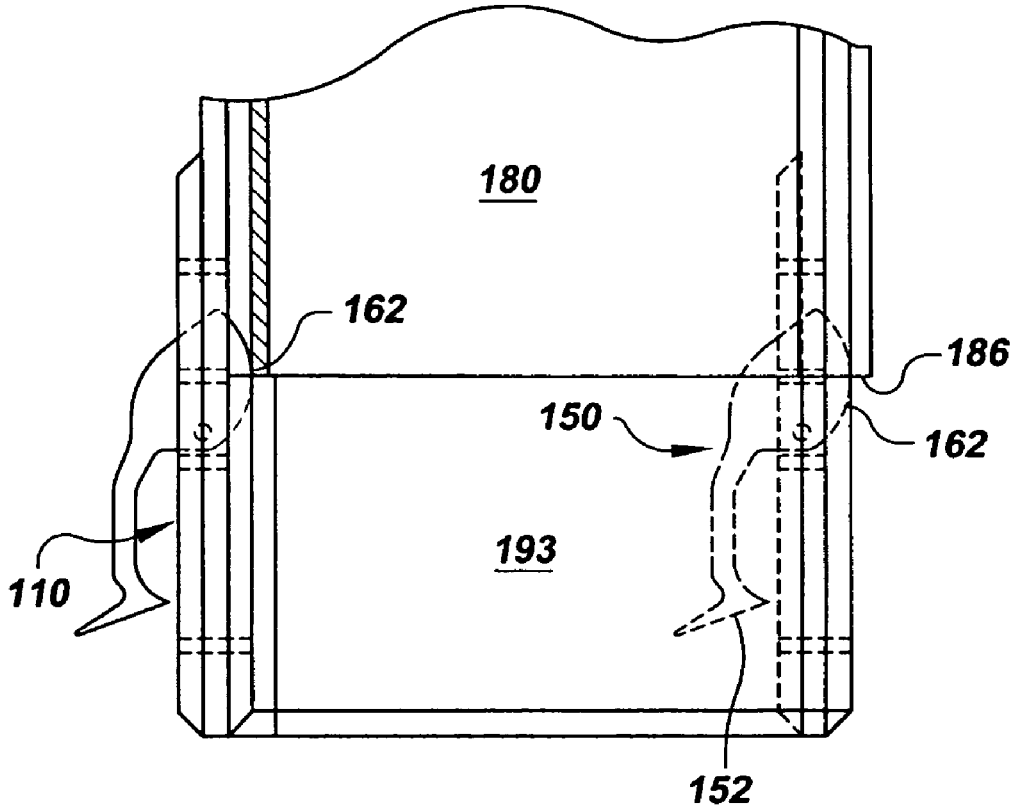

After the installation apparatus 100*a* and associated sheet pile 180 have been driven to the desired depth, the installation apparatus 100*a* is withdrawn from the soil formation, leaving the sheet pile 180 behind. As shown in FIG. 9C, the engagement end 152 of each catch 150 is configured such that as the installation apparatus 100*a* is withdrawn from the soil, the engagement end 152 rotates downwardly away from the sheet pile 180, thereby releasing it. Eventually, the engagement end 152 rotates downwardly and through a portion of the respective catch aperture 110, causing the opposing camming end 160 to similarly rotate through a portion of the catch aperture 110. Preferably, the camming end 160 engages the sheet pile 180 and urges it outwardly away from the installation apparatus 100*a*. As shown, the camming end 160 is configured such that the sheet pile 180 is urged outwardly from the installation apparatus 100*a* for a distance at least equal to the width of the ledge 193. As such, the ledge 193 clears the sheet pile 180 as the installation apparatus 100*a* is withdrawn from the soil.

Figure 10:
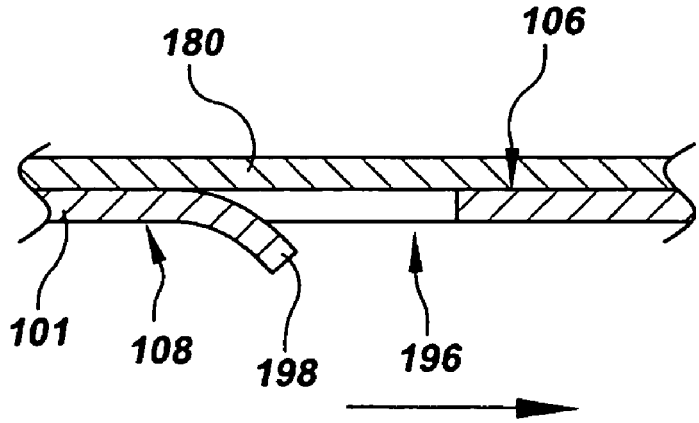
FIG. 10 is a partially cut-away, cross-sectional view taken along line 10—10 of FIG. 8.

As best seen in FIG. 10, the bottom edge of the removal aperture 196 extends upwardly and outwardly from the bottom surface 108 of the elongated body 101, thereby forming a scoop 198. As the installation apparatus 100*a* is withdrawn from the soil as indicated by the arrow, the scoop 198 engages soil disposed along the bottom surface 108 of the installation apparatus 100*a*, forcing the engaged soil through the removal aperture 196. The soil passing through the removal aperture 196 exerts force on the sheet pile 180, causing the sheet pile to be urged outwardly and away from the top surface 106 of the installation apparatus 100*a*. As well, the soil that passes through the removal aperture is forced between the sheet pile 180 and the top surface 106 of the installation apparatus 100*a*, thereby reducing friction between the two.

Figure 11:
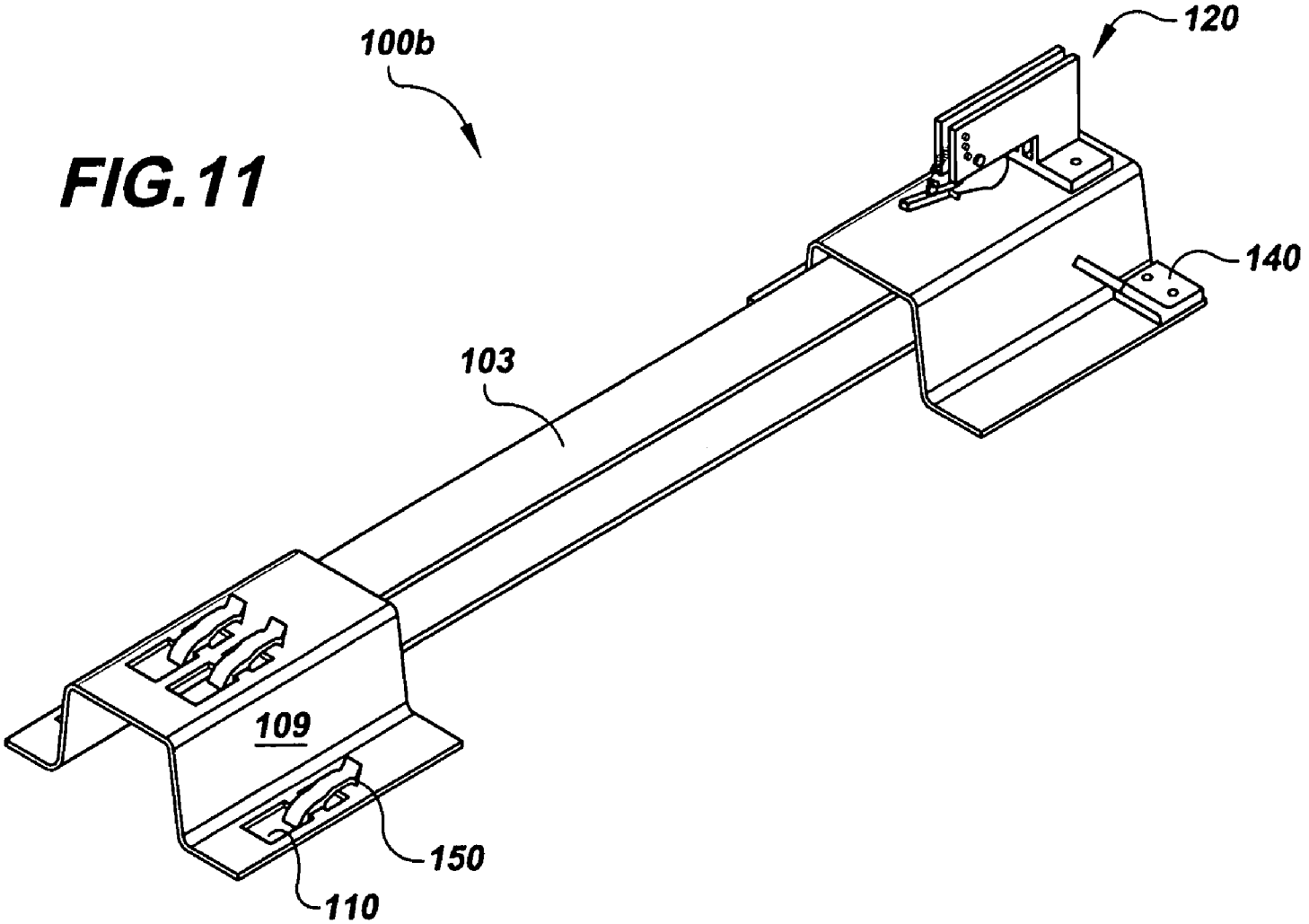
FIG. 11 is a perspective view of an alternate embodiment of a sheet pile installation apparatus in accordance with the present disclosure.

An alternate embodiment of a sheet pile installation apparatus 100*b* is shown in FIG. 11. The installation apparatus 100*b* includes body portions 109 positioned along a central member 103, preferably an I-beam. Similar to previously discussed embodiments, the installation apparatus 100*b* includes a clamp assembly 120 and catches 150 pivotally mounted in catch apertures 110. Preferably, the body portions 109 have cross sections that are similar to the cross section of the sheet piles 180 that are to be installed.

Figure 12:
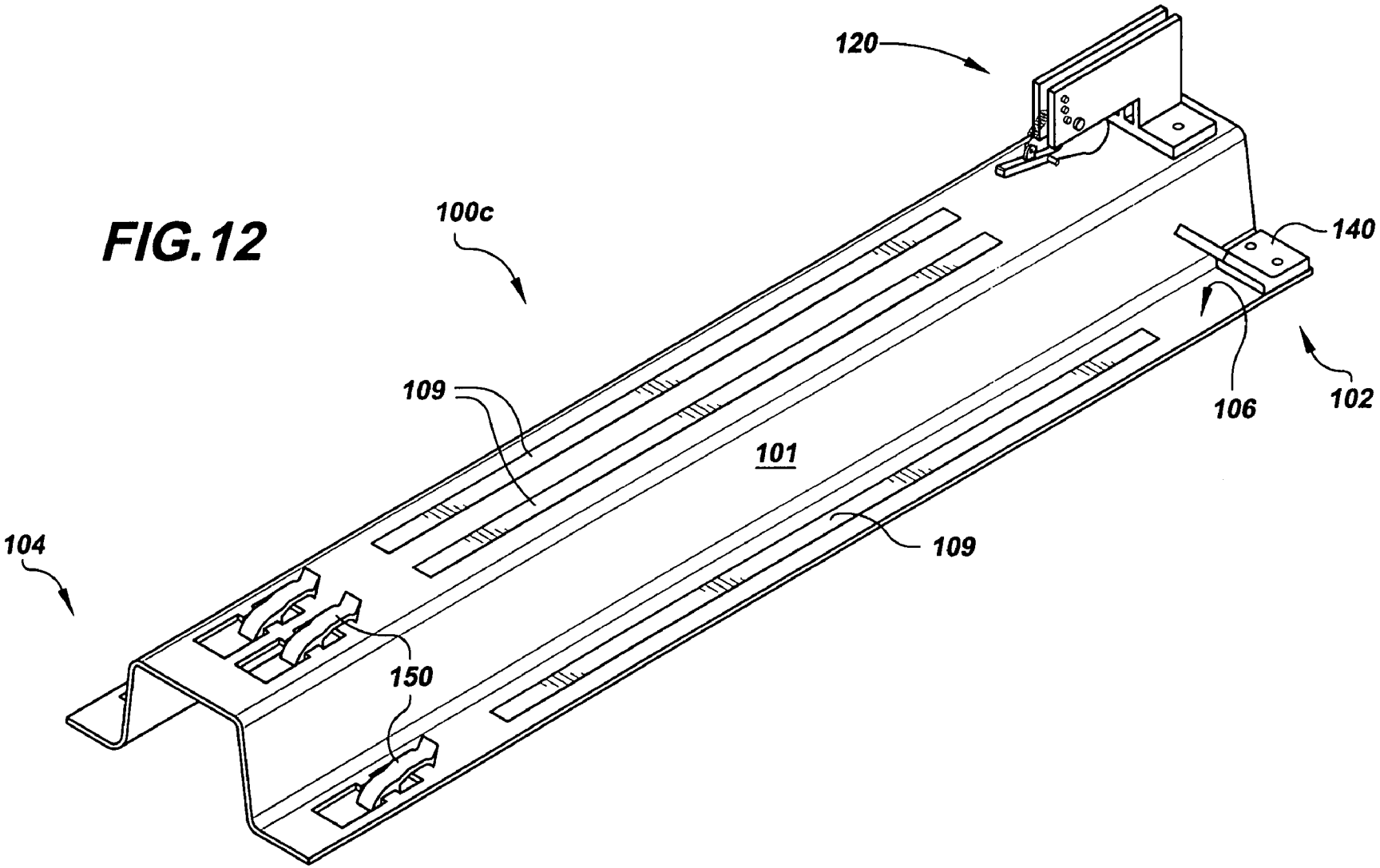
FIG. 12 is a perspective view of an alternate embodiment of a sheet pile installation apparatus in accordance with the present disclosure.

An alternate embodiment of a sheet pile installation apparatus 100*c* is shown in FIG. 12. The installation apparatus 100*c* includes strips 109 of material such as Teflon®, polyethylene, nylon, etc., that are secured to the top surface 106 of the elongated body 101. The strips 109 aid in reducing friction between the top surface 106 and the sheet pile 180 as the installation apparatus 100*c* is withdrawn from the soil. Preferably, the lower end of each strip is positioned six to twelve inches from the catches 150. As such, the lower edge 186 of the sheet pile 180 is urged inwardly by the catches 150 until the lower edge 186 is adjacent the top surface 106 during insertion of the installation apparatus 100*c* into a soil formation. Thus, soil is prevented from passing between the top surface 106 and the sheet pile 180 during insertion.

Although preferred embodiments of the sheet pile installation apparatus have been disclosed in detail herein, it will be obvious to those skilled in the art that variations and modifications of the disclosed embodiments can be made without departing from the spirit and scope of the sheet pile installation apparatus as set forth in the following claims.

Therefore, having thus described the invention, at least the following is claimed:

1. A sheet pile installation apparatus for inserting a sheet pile vertically into a soil formation, comprising:

an elongated body of uniform cross-section along its length, said body having an upper end, a lower end, a lower edge, a top surface, a bottom surface, and at least one aperture formed at said lower end;

a clamp assembly disposed on said upper end including:

a clamp bracket disposed on said top surface, a clamp pivotally mounted to said bracket, said clamp including a proximal end and a distal end, said proximal end being configured to engage a top end of the sheet pile; and a spring mounted to said clamp bracket and said distal end such that said proximal end is urged inwardly toward said top surface when said spring is in an at-rest position;

a catch including a first portion and a second portion, separated by a pivot axis, said catch being pivotally mounted in said aperture about said pivot axis such that said first portion and said second portion are disposed on opposed sides of said body when said catch is in an at-rest position, and wherein said first portion is configured such that insertion of said body into the soil formation rotates said first portion upwardly such that said first portion engages a lower end of the sheet pile disposed adjacent the top surface of the body.

2. The sheet pile installation apparatus of claim 1, wherein said first portion is a first length and said second portion is a second length, said first length being greater than said second length.

3. The sheet pile installation apparatus of claim 2, wherein said aperture further includes a top section and a bottom section separated by said pivot axis, and said second portion is rotatable through said top and bottom sections and said first portion is rotatable through said bottom section.

4. The sheet pile installation apparatus of claim 3, wherein said first portion of said catch is rotatable through said top section.

5. The sheet pile installation apparatus of claim 3, wherein said second portion of said catch is configured such that rotation of said first portion through said bottom section of said aperture causes said second portion to rotate through said top section and into contact with the lower end of the sheet pile adjacent said top surface, thereby urging the sheet pile away from said top surface.

6. The sheet pile installation apparatus of claim 1, wherein said clamp assembly is configured such that rotation of said distal end toward said top surface causes said proximal end to rotate away from said top surface.

7. The sheet pile installation apparatus of claim 5, wherein said proximal end further comprises a toothed surface configured to engage the top end of the sheet pile.

8. The sheet pile installation apparatus of claim 1, wherein a distal end of said first portion of said catch is configured to engage the soil as said body is withdrawn, thereby causing said first portion to be disengaged from the lower end of the sheet pile and rotate downwardly.

9. The sheet pile installation apparatus of claim 8, wherein said distal end of said first portion of said catch further comprises a deflector including a first edge configured to engage the lower end of the sheet pile, a second edge, and a planar surface extending therebetween, wherein said planar surface forms an angle with said top surface when said first edge contacts said top surface, said angle being less than 90°.

10. The sheet pile installation apparatus of claim 9, wherein said angle is in the range of 60° to 80°.

11. The sheet pile installation apparatus of claim 9, wherein said first edge of said deflector is serrated.

12. The sheet pile installation apparatus of claim 1, further comprising a ledge disposed on said top surface of said body along said ower end, said ledge extending outwardly from said top surface for at least a distance equal to a width of the sheet pile when the sheet pile is placed adjacent said body.

13. The sheet pile installation apparatus of claim 1, wherein said body further includes a removal aperture and a scoop, said scoop extending outwardly and upwardly from said bottom surface of said body such that as said sheet pile installation apparatus is removed from the soil, the soil is directed into said removal aperture by said scoop and between the sheet pile and said top surface of said body.

14. The sheet pile installation apparatus of claim 1, further comprising strips of material positioned longitudinally on the top surface of the elongated body, wherein said strips reduce friction between the top surface and the sheet pile.

15. A sheet pile installation apparatus for inserting a sheet pile vertically into a soil formation, comprising:

an elongated body arranged and configured to releasably receive the sheet pile, said body having an upper end, a lower end, a lower edge, a top surface, a bottom surface, and at least one aperture formed at said lower end;

a catch including a first portion and a second portion, separated by a pivot axis, said catch being pivotally mounted in said aperture about said pivot axis such that said first portion and said second portion are disposed on opposed sides of said body when said catch is in an at-rest position, and wherein said first portion is configured such that insertion of said body into the soil formation rotates said first portion upwardly such that said first portion engages a lower end of the sheet pile disposed adjacent the top surface of the body.

16. The sheet pile installation apparatus of claim 15, further comprising:

a clamp assembly disposed on said upper end, including:

a clamp bracket disposed on said top surface, a clamp pivotally mounted to said bracket, said clamp including a proximal end and a distal end, said proximal end being configured to engage a top end of the sheet pile; and a spring mounted to said clamp bracket and said distal end such that said proximal end is urged inwardly toward said top surface when said spring is in an at-rest position.

17. The sheet pile installation apparatus of claim 15, wherein said body is of a uniform cross-section along its length.

18. The sheet pile installation apparatus of claim 15, wherein said first portion is a first length and said second portion is a second length, said first length being greater than said second length.

19. The sheet pile installation apparatus of claim 15, wherein said aperture further includes a top section and a bottom section separated by said pivot axis, and said second portion is rotatable through said top and bottom sections and said first portion is rotatable through said bottom section.

20. The sheet pile installation apparatus of claim 15, wherein a distal end of said first portion of said catch is configured to engage the soil as said body is withdrawn, thereby causing said first portion to be disengaged from the lower end of the sheet pile and rotate downwardly.

21. The sheet pile installation apparatus of claim 15, wherein said distal end of said first portion of said catch further comprises a deflector including a first edge configured to engage the lower end of the sheet pile, a second edge, and a planar surface extending therebetween, wherein said planar surface forms an angle with said top surface when said first edge contacts said top surface, said angle being less than 90°.

22. The sheet pile installation apparatus of claim 21, wherein said angle is in the range of 60° to 80°.

23. The sheet pile installation apparatus of claim 15, further comprising a ledge extending outwardly from said top surface along said lower end of said body such that said ledge is adjacent a bottom end of the sheet pile when the sheet pile is placed adjacent said body.

24. The sheet pile installation apparatus of claim 15, further comprising strips of material positioned longitudinally on the top surface of the elongated body, wherein said strips reduce friction between the top surface and the sheet pile.

25. A sheet pile installation apparatus for inserting a sheet pile vertically into a soil formation, comprising:

an elongated body configured to releasably receive the sheet pile, said body having an upper end, a lower end, a lower edge, a top surface, a bottom surface, and at least one aperture formed at said lower end;

a catch including a first portion and a second portion, said catch being pivotally mounted in said aperture such that said first portion and said second portion are disposed on opposed sides of said lower end of said body when said catch is in an at-rest position, and wherein said first portion is configured such that insertion of said body into the soil formation rotates said first portion upwardly such that said first portion engages a lower end of the sheet pile disposed adjacent said top surface of said body.

26. The sheet pile installation apparatus of claim 25, wherein said upper and said lower end of said body are of a uniform crass-section.

27. The sheet pile installation apparatus of claim 26, wherein said body further includes a central member disposed between said upper end and said lower end of said body.

28. The sheet pile installation apparatus of claim 27, wherein said central member further comprises an I-beam.

29. The sheet pile installation apparatus of claim 25, wherein said catch further includes a pivot axis disposed between said first portion and said second portion and said first portion is a first length and said second portion is a second length, said first length being greater than said second length.

30. The sheet pile installation apparatus of claim 29, wherein said aperture further includes a top section and a bottom section separated by said pivot axis, and said second portion is rotatable through said top and bottom sections and said first portion is rotatable through said bottom section.

31. The sheet pile installation apparatus of claim 25, further including means for releasably securing an upper end of the sheet pile adjacent the upper end of said body.

32. A method of inserting a sheet pile vertically into a soil formation utilizing an installation apparatus, comprising:

placing the sheet pile adjacent the installation apparatus;

engaging a lower end of the sheet pile with the installation apparatus;

moving the installation apparatus downwardly into the soil formation; and in response to moving the installation apparatus downwardly into the soil formation, pulling the lower end of the sheet pile downwardly into the soil formation with the lower end of the installation apparatus.

33. The method of inserting a sheet pile of claim 32, wherein the step of engaging a lower end of the sheet pile with the installation apparatus occurs in response to moving the installation apparatus downwardly into the soil formation.

34. The method of claim 32, further comprising:

withdrawing the installation apparatus upwardly from the soil formation; and releasing the engagement of the sheet pile by the installation apparatus in response to the upward withdrawal of the installation apparatus from the soil formation so that the sheet pile remains in the soil formation.

* * * * *